United States Patent [19]

Bushee

[11] 4,297,987

[45] Nov. 3, 1981

[54] HEAT EXCHANGE SYSTEM

[75] Inventor: Lawrence C. Bushee, Florence, Ala.

[73] Assignee: Amana Refrigeration, Inc., Amana, Iowa

[21] Appl. No.: 38,089

[22] Filed: May 11, 1979

[51] Int. Cl.[3] ..... F24H 1/00

[52] U.S. Cl. ..... 126/351; 431/6; 431/12; 122/235 R; 237/8 D

[58] Field of Search ..... 431/285, 350, 62, 2, 431/12, 77, 258, 259; 126/116 A, 116 R, 374, 110 R, 351; 122/4 R, 23, DIG. 1, 2, 235 R; 237/8 D, 8 R; 432/222; 236/15 BD, 24; 165/165; 239/533.2, 567

[56] References Cited

U.S. PATENT DOCUMENTS

| | | | |
|---|---|---|---|
| 2,525,400 | 10/1950 | Crawford | 126/116 A X |
| 3,383,042 | 5/1968 | Mobus et al. | 237/8 D |
| 3,887,325 | 6/1975 | Finger et al. | 431/6 |
| 3,967,590 | 7/1976 | Hays et al. | 122/4 R |
| 3,997,109 | 12/1976 | Hays | 237/8 R |
| 4,008,038 | 2/1977 | Berthiaume | 431/2 X |
| 4,058,087 | 11/1977 | Rehm | 122/235 R |
| 4,095,930 | 6/1978 | Huston | 431/12 X |
| 4,135,487 | 1/1979 | Hays | 122/4 R X |

*Primary Examiner*—Samuel Scott
*Assistant Examiner*—Randall L. Green
*Attorney, Agent, or Firm*—Robert W. Hoke, II

[57] ABSTRACT

A package heat exchange system is disclosed having a burner positioned in the central plenum of a substantially cylindrical heat exchanger. A fuel-air mixture is supplied through a blower supplied with fuel from a pressure regulator which requires a somewhat less than atmospheric pressure at the blower inlet to draw gaseous fuel through the pressure regulator. A solenoid-operated, positive pressure valve in the main gasline provides the heat exchanger with an enriched gas mixture on ignition. The enrichment valve automatically closes after 30 seconds of operation. Air for combustion is drawn through a series of orifice plates positioned between the regulator and the blower. The fuel-to-air ratio may be altered by changing the size and/or number of the holes in one of the orifice plates. Further, one of the orifice plates may be deformable so as to form a seal, and to supply a predetermined quantity of air to the burner for combustion. The blower motor also drives a solution pump that circulates a fluid to the cylindrical heat exchanger and from there to a second heat exchanger for heating the air within an enclosure. The blower supplies the fuel-air mixture to the burner where it is ignited. An ignition reset timer automatically initiates an ignition cycle every 30 minutes as long as the thermostat is calling for heat. The products of combustion are radially exhausted upward through a wrapper surrounding the cylindrical heat exchanger and discharged from the package through a cap. The package heat exchanger system may be combined with a conventional air conditioning system to either heat or cool an enclosure, depending upon the mode desired.

11 Claims, 4 Drawing Figures

26
28
10
24
22
14
20
16
56
100
12
44
52
18
48
50
32
34
46
30

HEAT EXCHANGE SYSTEM

BACKGROUND OF THE INVENTION

Compact heat exchange systems using, for example, a burner positioned inside a plenum formed by a heat exchanger which has a surface area contacting the products of combustion which is substantially larger than the surface area contacting a fluid to be heated by the products of combustion can economically extract heat from the products of combustion. Highly efficient systems have developed to capitalize on compact heat exchange systems and cope with the concurrent problem of condensation deposits. Examples of such systems are described in U.S. Pat. Nos. 3,967,590, issued July 6, 1976; 3,997,109, issued Dec. 14, 1976; and 4,135,487, issued Jan. 23, 1979. They are shown combined with cooling systems in package units for external mounting, for example, in the backyard or on the roof of a home.

Being installed outside the home or other enclosure, such systems are subjected to greatly varied operating conditions. Rather than combusting fuel with air of a fairly constant temperature and humidity, they must combust whatever the outside environment offers. Hence, they are subjected to mixtures of greatly different enthalpies. This is further aggravated by the need to combust different fuels stored at varied temperatures depending upon the location and type of installation.

SUMMARY OF THE INVENTION

The invention relates to package heating and cooling systems for residential use and more particularly to an improved fuel and air metering and flow system for a compact burner positioned in the central plenum of a compact, substantially cylindrical heat exchanger of a package heating and cooling system. Most of the fuel is supplied to the burner through a blower. The blower draws the fuel from a pressure regulator which requires a somewhat less than atmospheric pressure at the blower inlet to activate the regulator and allow fuel to flow from the supply line. An additional amount of fuel is supplied to the heat exchanger on start-up through a solenoid operated, positive pressure valve in the main gas line. The solenoid valve automatically closes after 30 seconds. Air for combustion enters the system between the pressure regulator and the blower through apertures in a series of plates positioned on the side of the blower.

The blower is operated by a motor that also powers a solution pump. The pump circulates liquid through the cylindrical heat exchanger where it picks up heat generated by the combustion of the fuel-air mixture. From there, the heated liquid is pumped through an air-type heat exchanger. Air from an enclosure is blown through the air-type heat exchanger and returned to the enclosure at a higher temperature. Thus, the air of the enclosure is heated. An ignition reset timer automatically initiates an ignition cycle every 30 minutes as long as the thermostat is calling for heat.

The products of combustion from the burner are forced radially outward from the burner through a heat exchange matrix and into a surrounding wrapper. From the wrapper, the gases are deflected upward and radially exhausted through an insulated cap.

The primary object of the invention is to provide a heating system with a compact heat exchanger supplied with a fuel and air mixture for combustion by a metering and mixing system that provides a fuel enriched mixture for ignition.

Another object is to provide an automatic closure device for a fuel enrichment system for a compact heat exchanger to prevent the possibility of a build-up of fuel in the heat exchanger.

Other objects and advantages of the invention will become apparent from the following description, the accompanying drawings, and the appended claims.

DESCRIPTION OF THE PREFERRED EMBODIMENT

Figure 1:
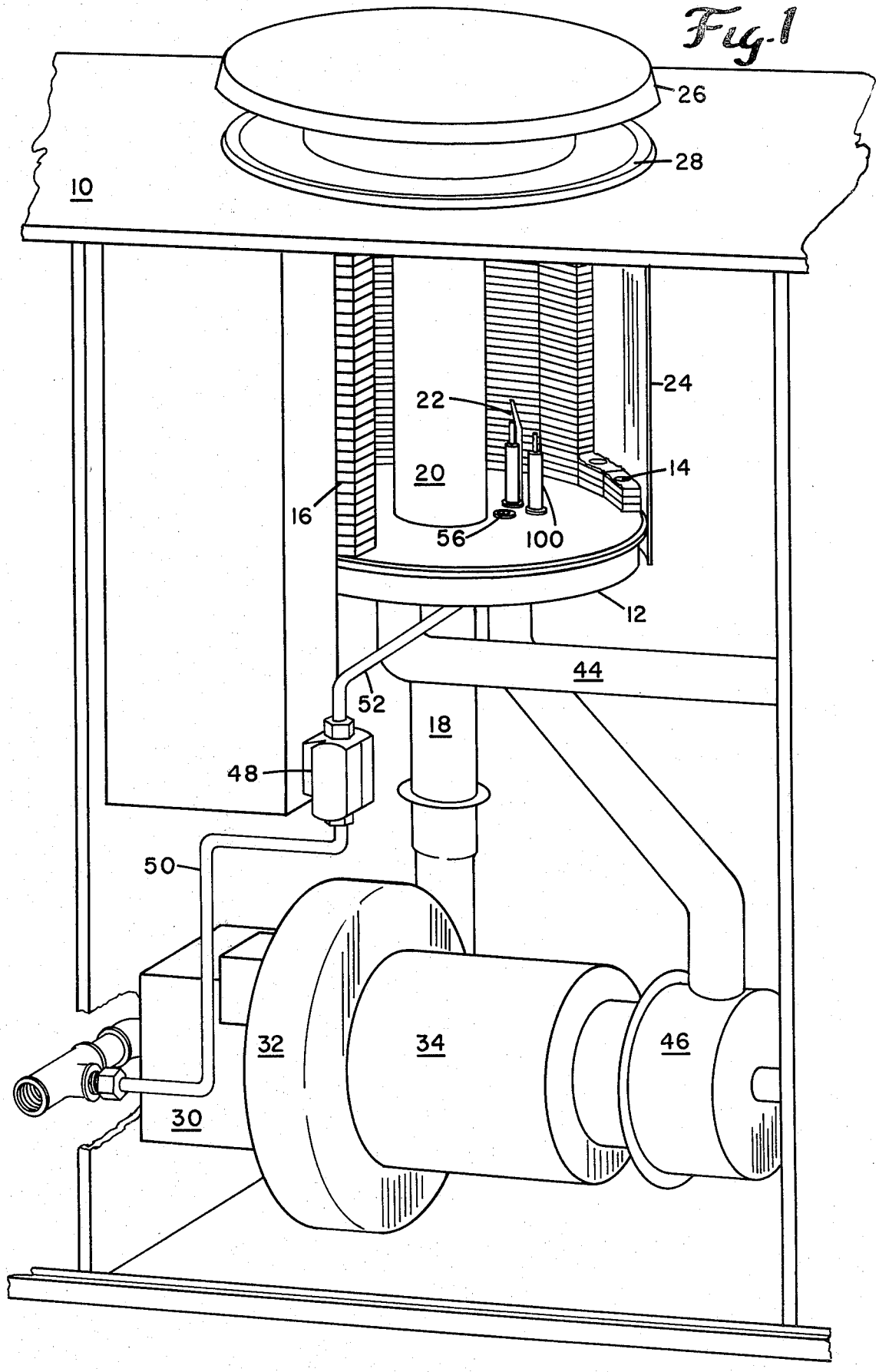
FIG. 1 is a perspective view, with portions broken away, of a heating and cooling system embodying this invention.
Figure 2:
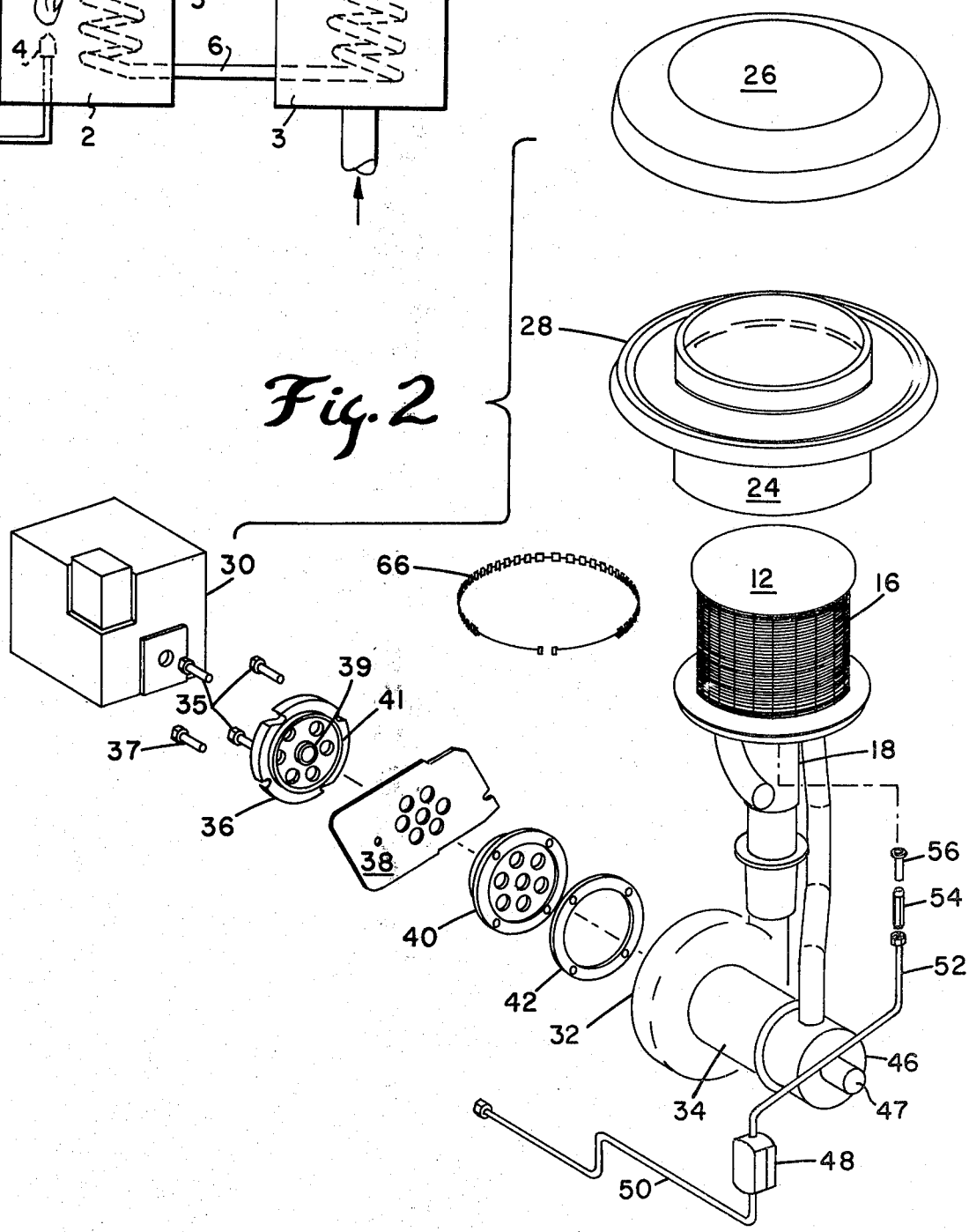
FIG. 2 is an exploded and elevated, perspective view of the heater unit of the heating system illustrated in FIG. 1.

Referring now to FIGS. 1 and 2, there is shown a package unit 10 having a base supporting side walls and a top which may be made of sheet metal. Positioned at one side of the package 10 and approximately midway between the ends thereof is a compact heater unit 12. Heater 12 consists of a cylindrical matrix comprising a plurality of tubes 14 through which is circulated a liquid to be heated. Tubes 14 are enclosed in a plurality of fins 16 to form the unitary, thermally stable matrix surrounding a central plenum. The fuel-air mixture enters heater 12 through intake tube 18, passes through the burner screen 20 and is ignited by spark gap 22. Flue gas, produced by the products of combustion from the burner screen 20 centrally located in the matrix plenum, is forced outwardly through the spaces between the fins 16 along radial heat exchange paths.

The escaping gases are deflected upward by a wrapper 24 and exhausted outwardly and downwardly through an insulated cap 26. Flange 28 redirects the escaping gases upwardly and away from the package 10. In this way, the package 10 is not unduly heated by the flue gases. Cap 26 is insulated with a suitable material such as fiberglass to reduce the heating effect caused by the escaping flue gases and to reduce the noise level of those escaping gases. Cap 26 and wrapper 24 serve the additional purpose of acting as a chimney for the system, eliminating the need for additional exhaust equipment.

Under these conditions large quantities of heat may be transferred from the burner 20 to the matrix. The liquid flowing through the tubes 14 extracts heat from the matrix to maintain all regions of the matrix below temperatures which would damage the matrix, for example, by melting the bonds between the fins and the tubes or by oxidizing the surface of the fins.

Fuel is supplied to the heater 12 through a solenoid controlled valve and pressure regulator 30 whose output is gas at a pressure slightly below atmospheric pressure. The output of regulator 30 is fed to the inlet of a blower 32 driven by a blower motor 34 so that blower 32 supplies a fuel-air mixture to the burner 20 of the heater 12.

As shown in FIG. 2, the inlet to blower 32 comprises three plates, numbered 36, 38, and 40, and a gasket 42. All three plates have a center hole allowing passage of fuel from regulator 30 to blower 32. The holes surrounding the center holes in each plates are air holes. When blower 32 is running, it creates a below-atmospheric pressure effect, drawing fuel from regulator 30 and air from the surroundings. By varying the size and number of air holes or the size of the fuel hole in plate 38, the system can be adapted to different fuel input rates and different fuel-air ratios.

For example, for natural gas with an input heating value of 80,000 BTU/hour, the fuel hole may measure 0.221 inches in diameter, and each of the air holes may measure 0.468 inches in diameter. Only three air holes, symmetrically disposed about the fuel hole, are needed for this application. For propane gas with an input heating value of 170,000 BTU/hour, the fuel hole may measure 0.266 inches and each of the air holes may measure 0.500 inches in diameter. In this application, six air holes are symmetrically disposed about the fuel hole as shown in FIG. 2.

The construction of orifice plate 38 makes the adaptation of the system to different operating conditions particularly easy. It is stamped from a relatively lightweight material such as SAE type 380 aluminum that is deformable under pressure. Plates 36 and 40 on the other hand, are made from a harder material such as heavier-weight cast aluminum alloy.

Orifice plate 38 is deformed to act as a gasket when tightened, preventing an uncontrolled amount of air from being drawn in from between plates 36 and 38 or between plates 38 and 40. This eliminates the need for a separate sealing member. Plate 38 is deformed under pressure by the action of ridges 39 and 41 in mating grooves in plate 40. If it is desired to change plate 38, screw 37 is removed and three other screws 35 are loosened. The old plate is then simply pulled out, and a new plate 38 is installed in its place.

Fuel is also supplied to the heater 12 through a solenoid-operated, positive pressure valve 48 connected to the main gas line through auxillary gas line 50. The outlet of valve 48 is connected to tubing 52 which is, in turn, connected to heater 12 through orifice 54 and fitting 56.

On a thermostat call for heat, the blower 32 is energized. It pulls gas from regulator 30, mixes it with air and forces the mixture into burner 20 where it is ignited. Simultaneously, solenoid-operated, positive pressure valve 48 in the main gas line provides burner 20 with an enriched gas mixture that assures fast, positive ignition. The enrichment valve 48 automatically closes after 30 seconds.

Figure 1A:
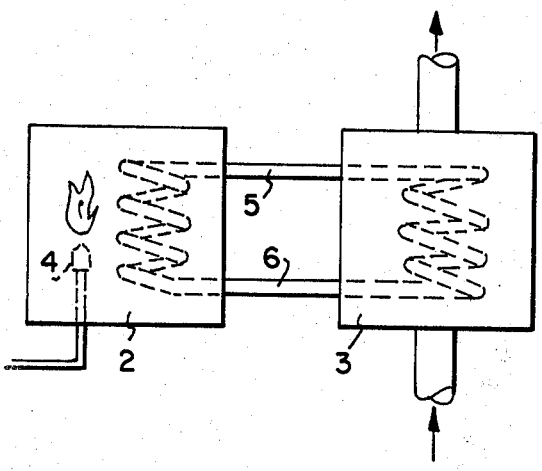
FIG. 1A is a block diagram of a heating system having first and second heat exchangers, according to the invention.

Liquid heated by the heater 12 is circulated through a pipe 44 to a heat exchanger, shown figuratively in FIG. 1A, at one end of package 10 and thence through return pipe 47, to a return pump 46 which forces the fluid back through the tubes 14 in the heater 12. Pump 46 is operated by motor 34 which also drives blower 32. Thus, if motor 34 malfunctions, neither fuel for combustion nor heat exchange liquid is supplied to heater 12. Hence, the possibility of the heater overheating because of combustion without the benefit of circulating liquid to carry away the heat of combustion is greatly reduced. The operation of heater 12 in package 10 to heat or cool an enclosure is more fully described in U.S. Pat. Nos. 3,967,590, issued July 6, 1976; 3,997,109, issued Dec. 14, 1976; and 4,135,487, issued Jan. 23, 1979.

FIG. 1A shows the coupling arrangement between first heat exchanger 2 and second heat exchanger 3. Burner 4 in heat exchanger 2 heats the fluid to be circulated through pipes 5 and 6. Air from the room moves through heat exchanger 3 and is returned to the room as heated air.

Figure 3:
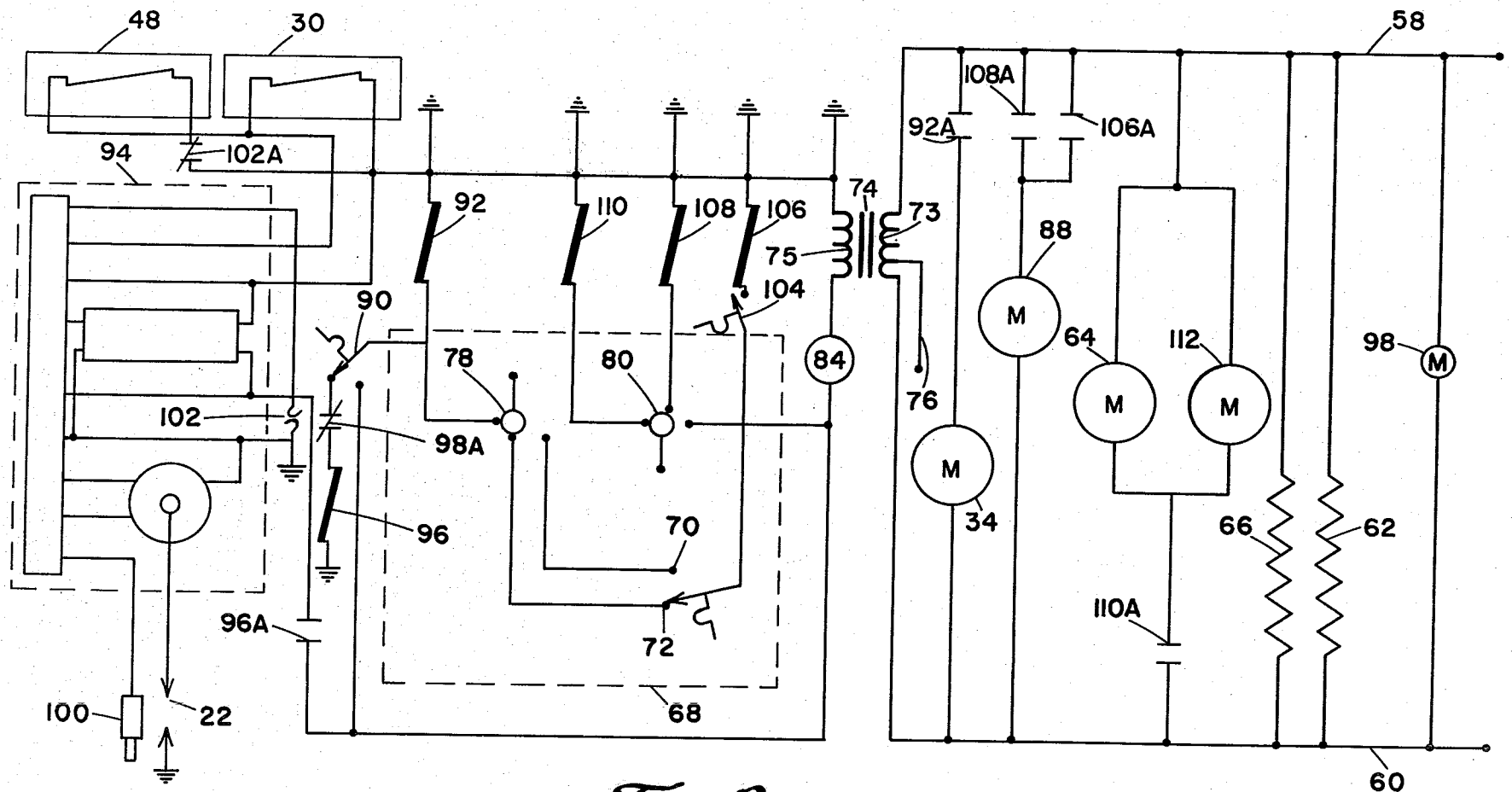
FIG. 3 is a schematic diagram of a control circuit for use with the system illustrated in FIGS. 1 and 2.

Referring now to FIG. 3 in conjunction with FIGS. 1 and 2, there is shown a control circuit for the package unit 10. Power line terminals 58 and 60 are each maintained at an AC voltage of, for example, 230 volts.

A crankcase heater 62, positioned in a compressor 64 and energized from terminals 58 and 60, supplies sufficient heat to the compressor crankcase to maintain the crankcase oil substantially free of condensed refrigerant thereby preventing foaming of the oil upon starting the compressor which would decrease the oil's lubricating ability. Heater 62 may have a small value of 10 to 50 watts.

A module heater 66 is also connected directly to terminals 58 and 60 and may have a value of 10 to 50 watts for normal operating conditions of the unit. Module heater 66 is clamped around the lower plenum of the gas fired heating unit 12 and maintains the fluid in tubes 14 of the heater at a temperature above the dew point at all times. As a result, substantially no deposits or condensate are produced on the heat exchanger.

While, if desired, the heater 66 may be deenergized during periods when the burner is actually firing, its power drain is very small. Hence, in the interests of reliability it is maintained continuously connected across the power bus. As a result, little or no condensate or other deposits form on the heat exchanger, and long, maintenance-free operation can be attained.

The temperature of the area being heated or cooled is monitored by a thermostat 68 located at any desired location in the house. Thermostat 68 may be two separate temperature responsive switches, one of which closes on temperature rise to activate the cooling system and one which closes on a drop in temperature to activate the heating system; or it may be one double-throw switch operated by a single temperature-sensitive element such as a bi-metal or bellows to perform the same function. For simplicity of illustration, the latter construction is shown. Contact 70 controls the cooling mode and contact 72 controls the heating mode.

Thermostat 68 is in a low voltage circuit from transformer 74 whose primary winding 73 is connected to terminals 58 and 60 which may be at 230 volts, as noted above, and reduces the output of the secondary winding 75 to the "low" voltage which is customarily 24 volts nominal and always under 30 volts. A feature of the transformer is a tap 76 in the primary winding 73. If a lower line voltage such as 208 volts is used, it is connected instead of the connection shown, thus changing the ratio of turns between the primary and secondary windings, and giving the same low voltage output.

One end of the secondary winding 75 of the transformer 74 supplies power through the various switches described below to the operating controls, as described below. The other end of the secondary winding and one side of each of the controls in the low voltage circuit are connected to ground to establish electrical continuity.

Included in the thermostat 68 are two selector switches. Switch 78 is used to select the operating mode of the thermostat as either "off", "heat", or "cool". Switch 80 is used to select operation of the device as either "on" or "automatic".

Switch 78, as shown, is in the "heat" position and switch 80 is in the "automatic" position. With switch 78 in the "heat" position, contact 72 is connected to the common terminal fed by an auxiliary limit control 84 and the contact 70 is disconnected. Moved one position to the right, switch 78 would disconnect all thermostatic positions while moving two positions to the right would disconnect the heat contact 72 and connect the cooling thermostatic contact 70. Switch 80 in the position shown provides automatic thermostatic control of the blower 88 whereas switch 80 moved one position to the right turns on blower 88 to run continuously.

With switch 78, switch 80, and switch 90 in the positions shown and the temperature limit of thermostat 68 properly set, for example, for contact 72 to close when the ambient temperature falls below 68° F., the unit cycles automatically. Thus, when contact 72 closes, it energizes relay 92 closing contacts 92A which supplies power to motor 34. Contact 72 also supplies power to a combustion control module 94 by energizing relay 96 through the normally closed contacts 98A of ignition reset timer motor 98. Once activated, relay 96 closes contacts 96A to power combustion control module 94, open gas valve 30, and sense the presence of a flame with a flame sensor comprising flame rod 100. Simultaneously, contacts 96A energize solenoid valve 48 through normally closed contacts 102A to provide an additional amount of gas to burner 20 on startup. After 30 seconds, thermal switch 102 opens contacts 102A, thereby deenergizing valve 48 and cutting off the flow of fuel through auxiliary gas line 50 to burner 20. The ignition flame sensing and control circuitry of control module 94 are conventional, and any desired circuit may be used. The opposite side of module 94 from contact 72 is returned to ground.

When the fluid in heat exchanger, not shown, has reached a predetermined temperature, such as 120° F., thermal switch 104 closes to energize relay 106, thus closing contacts 106A and thereby turning on blower 88 to circulate air in the heat exchanger, not shown, which is connected by appropriate ducting to the enclosure to be heated or cooled.

If during operation the temperature of the fluid exceeds the temperature limit set for the limit switch 90, switch 90 moves from the position shown to a second position, thereby shutting off the supply of fuel to the burner while maintaining power to motor 34. The temperatures selected for opening of switch 90 may be, for example, somewhat below the boiling point of the fluid. For example, if the fluid in tubes 14 is water, a temperature of approximately 200° F. may be chosen for the opening of the limit switch 90. The operation of switches 104 and 90 is more fully described in U.S. patent application Ser. No. 902,213, assigned to the same assignee as the present invention, and incorporated herein by reference. If switch 80 is shifted to the "on" position, relay 108 is energized closing relay contacts 108A in parallel with relay contacts 106A to retain the blower motor 88 energized continuously. Such operation is sometimes desirable to retain continuous circulation of air through a home.

The auxiliary limit control 84 is a manual reset device with a temperature sensitive disc. When it opens, all low voltage power is interrupted making the unit inoperative until manually reset as shown in FIG. 3. This control functions when there is an absence of liquid in the heater 12 to remove the heat of combustion, by sensing the temperature of the base of the heater directly. The primary limit control 90, on the other hand, is immersed in the liquid in a tube 14; it is in intimate contact with the medium being monitored. If the tube is devoid of liquid, however, the operation of control 90 is slow since the bulb must be heated by air rather than by liquid.

As a safeguard against electrical or gas interruption, an ignition reset timer 98 overrides the control system and automatically initiates an ignition cycle every 30 minutes by momentarily opening contacts 98A as long as the thermostat is calling for heat. Thus, the system will relight itself should ignition or combustion fail.

When it is desired to operate the package as a cooling system, the switch 78 is placed in the cooling position, and under these conditions when the temperature rises above a predetermined value, the switch 70 closes energizing a compressor relay coil 110. In the event that switch 80 is in the automatic position, it also energizes relay coil 108. Relay coil 110 closes contacts 110A and energizes compressor motor 64 and fan motor 112. When energized, the fan motor 112 cools the condenser coil, not shown, to cool the compressor refrigerant being pumped thereto by the compressor 64 as more fully described in U.S. patent application Ser. No. 901,213, already incorporated herein by reference.

From the foregoing, it will be apparent that all of the objectives of this invention have been achieved by the heat exchange system shown and described. It will also be apparent that various modifications and changes may be made by those skilled in the art without departing from the spirit of the invention as expressed in the accompanying claims. Therefore, all matter shown and described is to be interpretated as illustrative and not in a limiting sense.

What is claimed is:

1. A heat exchanger system for heating air within an enclosure, comprising:

(a) a heat exchanger containing a fluid;

(b) a burner positioned in the heat exchanger for heating the fluid;

(c) means for transferring heat from the heated fluid to air within the enclosure for heating the air;

(d) means for supplying fuel to the burner;

(e) means for moving a fuel-air mixture formed from the fuel and an available air supply to the burner for combustion; and (f) a deformable planar member associated with the means for moving the fuel-air mixture, for metering and mixing fuel with the air and forming a seal such that a predetermined quantity of air may be supplied to the burner for combustion.

2. A heat exchange system as recited in claim 1 wherein the planar member is disposed between the supply means and the moving means.

3. A heat exchange system as recited in claim 1 wherein the planar member has a first aperture formed therein to permit fuel to move from the supply means to the burner and a second aperture formed therein to permit air to enter and mix with the fuel as it is moved to the burner.

4. A heat exchange system as recited in claim 3 wherein the first aperture in the planar member has a diameter in the range of 0.2 inches to 0.4 inches and the second aperture in the planar member has a diameter in the range of 0.4 inches to 0.6 inches.

5. A heat exchange system as recited in claim 1 wherein the planar member is readily replaced with a second planar member by removing a single fastening means.

6. A heat exchange system as recited in claim 1, further comprising:

(a) means for sensing the temperature of the fluid as it passes through the first heat exchanger and controlling the operation of the burner in response to the temperature of the fluid; and (b) means for sensing the temperature of the first heat exchanger and controlling the operation of the burner when the first heat exchanger lacks sufficient fluid to permit the fluid temperature to be effectively sensed.

7. A heat exchange system as recited in claim 1 further comprising a second means for supplying fuel to the burner to provide an additional amount of fuel for ignition.

8. A heat exchange system as recited in claim 7 further comprising means for closing the second supply means after the fuel has been permitted to flow for a period of time.

9. A heat exchange system as recited in claim 8 wherein the second supply means is in parallel flow with the first supply means.

10. A heat exchange system as recited in claim 1 wherein the means for transferring heat from the heated fluid to air within the enclosure further comprises a second heat exchanger arranged such that air from the enclosure can be moved through the second heat exchanger and returned to the enclosure.

11. A heat exchange system as recited in claim 1 wherein the seal is formed by pressure on the deformable planar member, and the deformable planar member is pressed between the fuel supply means and the means for moving the fuel-air mixture.

* * * * *